United States Patent [19]

Welzel

[11] Patent Number: 4,964,675

[45] Date of Patent: Oct. 23, 1990

[54] METHOD OF ELECTRO-HYDRAULIC CONTROL OF LONGWALL MINE UNITS

[75] Inventor: Josef Welzel, Wuppertal, Fed. Rep. of Germany

[73] Assignee: Herman Hemscheidt Maschinenfrabrik GmbH & Co., Wupperal, Fed. Rep. of Germany

[21] Appl. No.: 392,551

[22] Filed: Aug. 11, 1989

[30] Foreign Application Priority Data

Aug. 13, 1988 [DE] Fed. Rep. of Germany ..... 3827559

[51] Int. Cl.[5] ..... E21D 23/12

[52] U.S. Cl. ..... 299/1; 299/11; 405/302

[58] Field of Search ..... 299/1, 10, 30, 33; 405/302; 91/170 MP

[56] References Cited

U.S. PATENT DOCUMENTS 3,285,015 11/1966 Carnegie et al. ..... 405/302
3,606,758 9/1971 Gotze ..... 405/302 X
4,708,394 11/1987 Trox et al. ..... 299/1
4,887,935 12/1989 Koppers et al. ..... 405/302

FOREIGN PATENT DOCUMENTS 1533776 1/1978 Fed. Rep. of Germany .

*Primary Examiner*—Ramon S. Britts
*Assistant Examiner*—David J. Bagnell
*Attorney, Agent, or Firm*—Berman, Aisenberg & Platt

[57] ABSTRACT

A method of electro-hydraulic control of the cutting and self-advancing mine-roof support units in an automated longwall is carried out in dependence on the measured lengths to which the rams pushing the support are extended, with extraction by the cutter occurring in long cuts extending over almost the entire length of the longwall. After each extraction cut, the conveyor is advanced by an amount equal to the depth to which the cutter has cut, and the process of advancing each group is triggered in dependence on the length to which the pushing rams have been extended. The self-advancing roof-support units inserted in the longwall are divided into groups which, depending on the respective state of operation, are moved forward individually and successively, in each case by a preset extension length of the pushing rams.

4 Claims, 1 Drawing Sheet

METHOD OF ELECTRO-HYDRAULIC CONTROL OF LONGWALL MINE UNITS

The invention relates to a method of electrohydraulic control of cutting and self-advancing support units in an automated longwall.

BACKGROUND OF THE INVENTION

It is known for the conveying and extraction equipment installed in a longwall, together with the self-advancing support, to be monitored from a control station. During extraction, the pushing grams of the self-advancing support units connected to the conveyor are pressurised so that the cutter exerts continuous pressure on the working face. In order to monitor and control the sequence of operation, the instantaneous position of the cutter in the longwall and the extent to which the pushing rams are extended is measured and transmitted to the control station, which is usually outside the longwall. After the extraction process, the support is moved forward in dependence on the measurements transmitted to the control station.

Coal is usually extracted in stages by cutting successive parts of the longwall. The self-advancing support units are moved forward after the conveyor has advanced by the full length to which the pushing ram is extended. Cutting in stages is advantageous because the exposed roof is carried by the support soon after extraction and because irregularities in the longwall can be compensated by suitable work afterwards. On the other hand, it is difficult to keep the longwall straight. Since extraction and advance operations are carried out in different regions of the longwall, it is difficult to monitor and synchronize the sequences of operations, and this results in idle times for both the cutter and the self-advancing support unit.

On the other hand, cutting in long strokes, covering nearly the entire length of the longwall, results in considerable delays to the self-advancing support, because the support can be advanced only after the entire length of the longwall has been exposed by cutting by an amount equal to the extension length of the pushing rams. In addition, the self-advancing operations interfere with extraction. In the case of long cutter strokes, however, it is easier to keep the longwall straight.

A straight longwall is obtained if the cutter cuts to a substantially uniform depth during each extraction cut. However, the depth of cut cannot be made uniform if the conveyor is continuously pressed by the pushing rams, because the solid coal does not have uniform consistency. The cutter is pressed into soft coal to a greater extent than in parts of a seam containing hard coal. The result is a non-uniform undulating curve which intensifies as the extraction proceeds. Accordingly, DE-AS No. 15 33 776 proposes that the extension length of a pushing ram should be limited to a predetermined cutting depth of the cutter, using a metering cylinder as a quantity-control device. During the extraction travel of the cutter, the supply of pressure medium to the pushing ram is stopped so that the cutter abuts against the column of liquid in the pushing ram. After extraction, the pushing ram is supplied via the metering cylinder with a metered amount of pressure fluid corresponding to extension as far as the preset cutting depth. However, there is no coupling between the extraction process and the self-advancing work.

The object of the invention therefore is to devise an efficient method of obtaining a controlled sequence, well matched in time and space, of extraction and self-advancing support work in an automated longwall operation.

SUMMARY OF THE INVENTION

By means of the invention, extraction using the cutter is closely combined with the operation of the supports to produce an efficient working process. Since the cutting depth of the cutter is seldom constant but variable by various quantities such as the drive power, drill position and, more particularly, the hardness of the coal, the extent to which the pushing ram is extended ia determined by the depth of cutting reached on each occasion. Extraction occurs in long strokes, and the pushing rams for moving the conveyors are extended only after each extraction cut when the cutter has passed a preset place at the end of the longwall. In a special step, the pushing rams are then successively supplied with pressure fluid in a short sequence, beginning from the other end of the longwall, and are extended by a length corresponding to the respective cutting depth of the cutter.

The self-advancing support units disposed in the longwall are divided into groups the size of which depends on the ratio of the total number of support units to the number of extraction steps which can be carried by the complete stroke of the pushing rams. The individual support groups are individually programmed in accordance with a special advance schedule and in a set sequence so that the support units are moved forward individually and in alternating sequence from the two ends of the longwall to the middle thereof. The control signal for initiating the process of advancing a support group is generated as soon as the pushing cylinder reaches a preset extension length. The instantaneous extension length of the pushing rams in a group is determined in dependence on the depth of cutting of the cutter and in accordance with the number of extraction outs which have been made, and the extension length can vary from the depth of one cut to a complete step of the pushing rams.

The support is moved forward without delay and simultaneously with extraction. The sequence of processes for advancing a support group is triggered at each cut. The individual groups are moved forward in a fixed sequence over a distance corresponding to the respective state of operation. Owing to the continuous operation of the support, the support follows the ad-Vancing conveyor at a relatively short interval, although the longwall is cut in long strokes, extending over the entire length thereof. The extraction and support sequences are well matched in space and time, resulting in automated, efficient longwall operation.

BRIEF DESCRIPTION OF THE DRAWING

Other details of the method according to the invention will now be explained with reference to an embodiment shown in the drawing, in which.

DESCRIPTION OF THE PREFERRED EMBODIMENT

Figure 1:
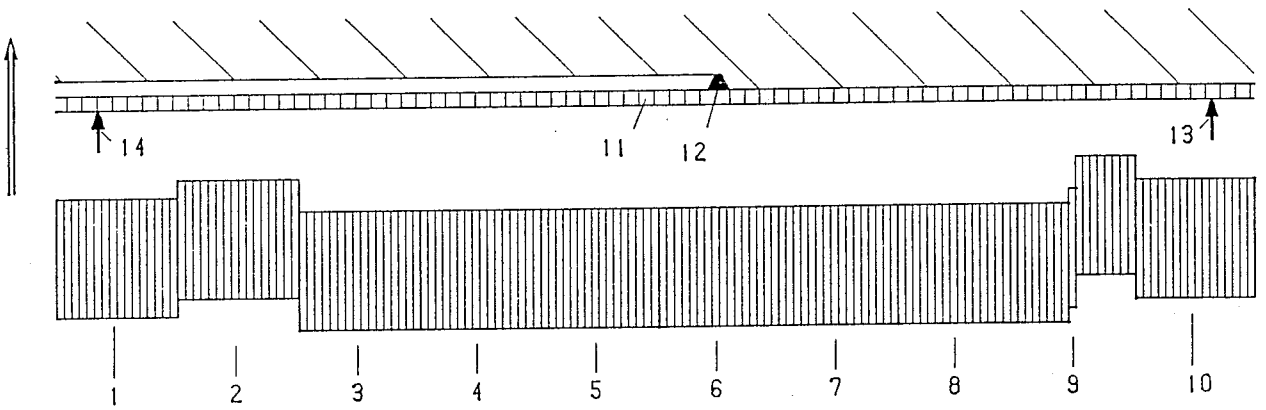
FIG. 1 is a diagram of the sequence of operation in a longwall during the fifth extraction step.

The drawings show a plan view of the longwall in which 160 self-advancing support units are inserted and divided into 10 groups of 16 units each. In the embodiment it is assumed that the length of advance (stroke) of the pushing rams is ten times the cutting depth of the cutter.

The 10 support groups are denoted by references 1 to 10. The coal for mining is shaded and the direction of extraction is indicated by a long arrow. A conveyor 11 is disposed between the support groups 1–10 and the coal, and a cutter 12 moves along the conveyor on the working-face side. References 13 and 14 denote preset positions of the cutter 12 at a distance corresponding to the width of 6 support units from the respective end of the longwall. The individual support units are connected to the conveyor 11 by pushing rams (not shown by means of which the conveyors 11 are advanced in the direction towards the working face and also the support units are moved up during the advance process. The length to which the pushing rams are extended is measured by motion pick-ups.

The sequences of operation in the longwall are regulated by an electro-hydraulic control system. The system comprises a control station disposed outside the longwall, comprising a utter position indicator. The individual operating steps in the longwall are controlled by the control station, which receives all important measurements from the longwall.

At the beginning of extraction, the support groups 1 to 10 are disposed parallel to the working face and alongside the coal and at the same distance from conveyor 11. During the first extraction step the cutter 12 is pulled to the right from the bottom left end of the longwall. In the process the coal is cut by the cutter 12 to a given depth, without the pushing rams pressing against the conveyor 11. The extraction cuts extend over the entire length of the longwall. As soon as cutter 12, after the first extraction cut, has reached the preset position 14 at the top end of the longwall, the advance of the pushing rams is triggered via the control station y means o& the motion pick-ups, the pushing rams are now extended by an amount exactly equal to the cutting depth of cutter 12. The pushing rams are supplied with pressure medium, not simultaneously but successively in a brief sequence, so as to reduce the current consumed by the control magnets initiating the pushing operation and prevent an abrupt pressure drop in the high-pressure line.

As soon as cutter 12 has passed the position 14 and reached the top end of the longwall, a control signal triggers the sequence of the advance process in the self-advancing support group 1 at the bottom end of the longwall. The frames of the group 1 of self-advancing supports are then moved forward in succession by the amount equal lo the depth of cutting and in the direction of the working face.

This is followed by the second extraction step in which the pushing rams are unpressurised as before and the cutter 12 is returned from the top to the bottom end of the longwall. In the present case, the order from the control system to extend the pushing rams by an amount equal to the depth of cutting is emitted from position 13 at the bottom end of the longwall. A control signal is then delivered to the support group at the top end of the longwall where the support units successively advance by an amount equal to twice the depth of cutting.

FIG. 1 shows the sequence of operations during the fifth extraction step. Previously, after the third extraction cut, the support group 2 is moved forward by three times the cutting depth, and after the fourth extraction cut the advance sequence is initiated in group 9. In the drawing showing the fifth extraction out, the cutter 12 has already cut and exposed the bottom half of the longwall length on the way to the upper end of the longwall, the pushing rams being non-pressurised as before. In the group 9 in which the sequence is occurring, half the self-advancing support units have advanced four times the depth of cut.

Figure 2:
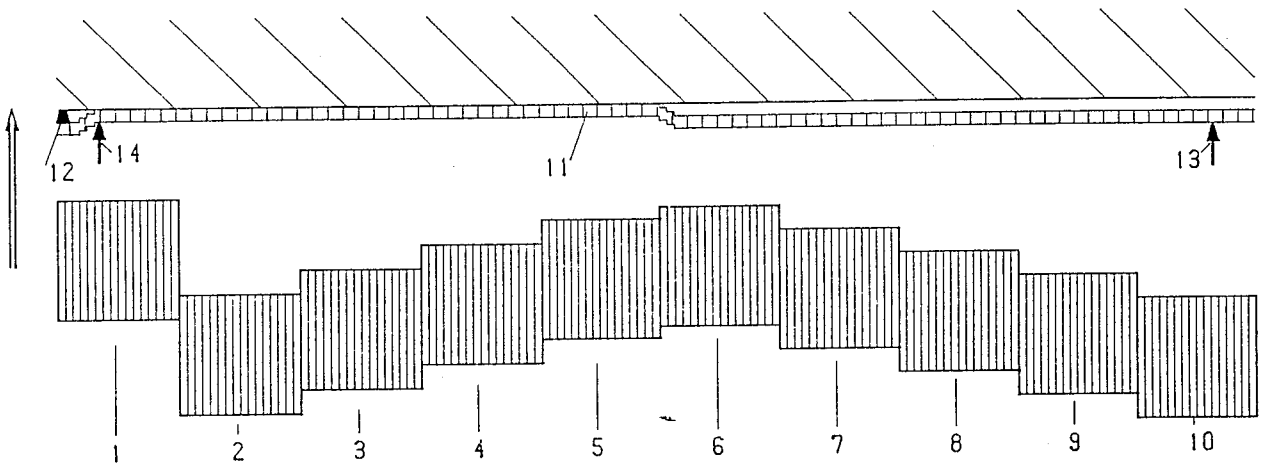
FIG. 2 is a corresponding diagram of the sequence of operation after the twelfth extraction step.

FIG. 2 shows the sequence after the twelfth extraction cut. As a result of applying the method of operation according to the invention, after the tenth extraction cut the groups 1 to 10 are disposed in an arc facing the conveyor 11, which is straight as before, whereas the two groups 1 and 10 at the ends of the longwall are furthest in the rear. From the eleventh extraction cut onwards, the support units are advanced by a full step length of the pushing ram, when group l again begins to form an arc. This ensures that, during the extraction of coal, the support remains behind by an average of only half a step length, and the maximum distance is not more than a step length of the pushing ram.

After the twelfth extraction step, group 1 has already advanced by a complete step. Cutter 12 has just passed the position at the bottom end of the longwall and has triggered the extension of the pushing ram by an amount equal to the depth of cutting already made towards the centre of the longwall. The next advance process can be initiated in the tenth group, starting from the bottom end of the longwall.

No automatic means are provided for returning the support units to the initial position parallel to the conveyor at the end of each working cut because the longwall can without difficulty be left in any operating position. If however it is regarded as advantageous to return the support to the starting position, this can be done without difficulty by corresponding manual actuation of the control stations.

I claim:

1. A method of electro-hydraulic control of a cutting unit incorporating a cutter and self-advancing mine-roof support units in an automated longwall mine, the cutter being guided on a conveyor moved parallel to the working face and extraction being carried out in long cuts extending over substantially the entire length of the longwall with the self-advancing support units and pushing rams forming parts thereof being connected to the conveyor and being advanced in groups depending on the measured length to which the pushing rams are extended, which method includes the steps of:

(a) triggering the extension of the pushing rams for pushing the conveyor from a preset position of the cutter after each extraction cut, the pushing rams being extended to lengths adapted to the depths to which the cutter has cut;

(b) generating a control signal for the sequence of the advance process in one self-advancing support group as soon as the pushing rams have advanced to a preset length as determined by the cutting depth of the cutter and by the number of extraction cuts that have been made; and (c) moving the self-advancing support groups forward individually and in alternating succession from the two ends of the longwall to the middle thereof.

2. A method according to claim 1 which includes the step of determining the periphery of a self-advancing support group from the number of support units in the longwall in relation to the number of extraction cuts per length of advance of the pushing ram.

3. A method according to claim 1 which includes the step of triggering the extension of the pushing rams after each extraction cut from preset positions of the cutter near the ends of the longwall.

4. A method according to claim 1 which includes the step of supplying the pushing rams with pressure fluid in succession and in a short sequence.

* * * * *